US006990822B2

(12) United States Patent
Matsuoka

(10) Patent No.: US 6,990,822 B2
(45) Date of Patent: Jan. 31, 2006

(54) PRESSURE ADJUSTING DEVICE FOR AIR CONDITIONING SYSTEM AND AIR CONDITIONING SYSTEM EQUIPPED WITH THE SAME

(75) Inventor: Hiromune Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/479,854

(22) PCT Filed: Mar. 10, 2003

(86) PCT No.: PCT/JP03/02814

§ 371 (c)(1),
(2), (4) Date: Dec. 8, 2003

(87) PCT Pub. No.: WO03/078903

PCT Pub. Date: Sep. 25, 2003

(65) Prior Publication Data

US 2004/0144111 A1 Jul. 29, 2004

(30) Foreign Application Priority Data

Mar. 18, 2002 (JP) ..... 2002-074378

(51) Int. Cl.
*F25B 41/04* (2006.01)

(52) U.S. Cl. ..... 62/224; 62/222; 62/193

(58) Field of Classification Search ..... 62/160, 62/217, 199, 150, 468, 193, 224, 222

See application file for complete search history.

(56) References Cited

U.S. PATENT DOCUMENTS 3,702,066 A * 11/1972 Beatenbough et al. ..... 62/222
3,965,693 A * 6/1976 Widdowson ..... 62/217

(Continued)

FOREIGN PATENT DOCUMENTS

JP 04-340063 11/1992

(Continued)

*Primary Examiner*—Marc Norman
(74) *Attorney, Agent, or Firm*—Shinjyu Global IP Counselors, LLP

(57) ABSTRACT

The present invention relates to an air conditioning system provided with an outdoor unit having a compressor and an outdoor heat exchanger, an indoor unit having an indoor heat exchanger, and a gaseous refrigerant pipe connecting the indoor heat exchanger to the compressor. The present invention serves to make it possible to run such an air conditioning system in cooling mode continuously even when the outside air temperature is low by preventing the indoor heat exchanger from freezing. The air conditioning system is provided with one air-cooled outdoor unit and a plurality of indoor units connected in parallel to the outdoor unit. The indoor heat exchangers and the compressor are connected together by the gaseous refrigerant pipe. A pressure adjusting device is installed in the gaseous refrigerant pipe. The pressure adjusting device is a single integral unit equipped with a pressure detecting means, an electric powered expansion valve, and an opening adjusting means and functions to adjust the pressure in the indoor heat exchanger to a higher pressure than the pressure in the indoor heat exchangers of the other indoor units.

17 Claims, 6 Drawing Sheets

U.S. PATENT DOCUMENTS 3,998,570 A * 12/1976 Jacobs ..... 417/274
4,084,388 A * 4/1978 Nelson ..... 62/152
4,184,341 A * 1/1980 Friedman ..... 62/175
4,442,680 A * 4/1984 Barbier et al. ..... 62/217
4,589,263 A * 5/1986 DiCarlo et al. ..... 62/193
4,621,505 A * 11/1986 Ares et al. ..... 62/509
4,934,156 A * 6/1990 Barbier ..... 62/217
4,987,747 A * 1/1991 Nakamura et al. ..... 62/160
5,564,282 A * 10/1996 Kaye ..... 62/160

FOREIGN PATENT DOCUMENTS

JP 08-166174 6/1996

* cited by examiner

PRESSURE ADJUSTING DEVICE FOR AIR CONDITIONING SYSTEM AND AIR CONDITIONING SYSTEM EQUIPPED WITH THE SAME

TECHNICAL FIELD

The present invention relates to a pressure adjusting device for an air conditioning system and, more particularly, to a pressure adjusting device for adjusting the pressure in the indoor heat exchanger of an air conditioning system provided with an outdoor unit having a compressor and an outdoor heat exchanger, an indoor unit having an indoor heat exchanger, and a gaseous refrigerant pipe connecting the indoor heat exchanger to the compressor. The invention also relates to an air conditioning system equipped with such a pressure adjusting device.

BACKGROUND ART

An example of an air conditioning system that is divided into an outdoor unit and an indoor unit is shown in FIG. 4. The air conditioning system 101 has one air-cooled outdoor unit 102 and a plurality of (more specifically, three) indoor units 103, 104, 105 and is used to air-condition an office or the like. The outdoor unit 102 is equipped with a compressor 111 and an outdoor heat exchanger 112 and is installed outdoors. The indoor units 103, 104, 105 are each equipped with an expansion valve 113, 114, 115 and an indoor heat exchanger 123, 124, 125 and installed in an indoor room 133, 134, 135. The outdoor heat exchanger 112 and the expansion valves 113, 114, 115 are connected together by a liquid refrigerant pipe 116. The indoor heat exchangers 123, 124, 125 and the compressor 111 are connected together by a gaseous refrigerant pipe 117.

In this air conditioning system 101, as shown in FIGS. 4 and 5, the gaseous refrigerant is compressed by the compressor 111 from the state at point A0 to a prescribed pressure Pd0 (see point B0 in FIGS. 4 and 5) before being delivered to the outdoor heat exchanger 112. In the outdoor heat exchanger 112, the gaseous refrigerant exchanges heat with the outside air and condenses, changing to a liquid refrigerant state (see point C0 in FIGS. 4 and 5). This condensed liquid refrigerant is delivered from the outdoor heat exchanger 112 to the expansion valves 113, 114, 115 of the indoor units 103, 104, 105 through the liquid refrigerant pipe 116 and the pressure of the liquid refrigerant is reduced to Ps0 (see point D0 in FIGS. 4 and 5) by the expansion valves 113, 114, 115. In the indoor heat exchangers 123, 124, 125, the pressure-reduced refrigerant exchanges heat with the air inside each respective room and evaporates, changing to a gaseous refrigerant state (see point A0 in FIGS. 4 and 5). The evaporation temperature of the refrigerant at the indoor heat exchangers 123, 124, 125 is the temperature T0 corresponding to the pressure Ps0. The gaseous refrigerant is drawn into the compressor 111 through the gaseous refrigerant pipe 117. In this way, the air inside the rooms is cooled.

Due to the increased use of computers in recent years, the floor space of offices and the like is often partitioned to provide server rooms for the computers. In this kind of server room, it is necessary to run the indoor unit in cooling mode constantly regardless of the season in order to process the heat discharged by the server equipment.

However, when the outside air temperature is low, such as in the winter, the refrigerant evaporated in the indoor heat exchangers 123, 124, 125 of the conventional air conditioning system 101 partially changes to a liquid (see point E0 in FIGS. 4 and 5) by the time it reaches the compressor 111 through the gaseous refrigerant pipe 117 after leaving the outlets of the indoor heat exchangers 123, 124, 125 (see point A0 in FIGS. 4 and 5). When this partially liquefied refrigerant is drawn into the compressor 111, such problems as damage to the compressor 111 and insufficient intake of gaseous refrigerant occur.

Therefore, conventionally, the openings of the expansion valves 113, 114, 115 are adjusted such that the refrigerant pressure in the indoor heat exchangers 123, 124, 125 is lowered (see point D1 and pressure Ps1 in FIG. 5) and the evaporation temperature of the refrigerant in the indoor heat exchangers 123, 124, 125 is brought to a temperature T1 that is lower than the outside air temperature, thus preventing the gaseous refrigerant from liquefying inside the gaseous refrigerant pipe 117 (see point A1 in FIG. 5).

If the evaporation temperature of the refrigerant is lowered too much, however, the refrigeration cycle of the air conditioning system 101 will be along the lines joining points A1, B1, C1, and D1 in FIG. 5 and the indoor heat exchangers 123, 124, 125 will freeze. As a result, it will not be possible to continue running the indoor units 103, 104, 105. When such a situation occurs, the indoor units 103, 104, 105 are generally run in fan-only mode to increase the temperature of the frozen indoor heat exchangers 123, 124, 125 and return them to an unfrozen state. In a room, such as server room (assume, for example, that room 133 in FIG. 4 is a server room), where the amount of discharged heat is large, the temperature inside the room will rise rapidly when the cooling operation is stopped and the operation of the server equipment could possibly be impeded.

DISCLOSURE OF THE INVENTION

The present invention relates to an air conditioning system provided with an outdoor unit having a compressor and an outdoor heat exchanger, an indoor unit having an indoor heat exchanger, and a gaseous refrigerant pipe connecting the indoor heat exchanger to the compressor. The object of the present invention is to make it possible to run such an air conditioning system in cooling mode continuously even when the outside air temperature is low by preventing the indoor heat exchanger from freezing.

An air conditioning system pressure adjusting device for adjusting the pressure in the indoor heat exchanger of an air conditioning system that is provided with an outdoor unit having a compressor and an outdoor heat exchanger, an indoor unit having an indoor heat exchanger, and a gaseous refrigerant pipe connecting the indoor heat exchanger to the compressor. The pressure adjusting device is provided with a pressure detecting means, an electric powered expansion valve, and an opening adjusting means. The pressure detecting means detects the pressure value of the refrigerant in the indoor heat exchanger. The electric powered expansion valve is disposed in the gaseous refrigerant pipe. The opening adjusting means adjusts the opening of the electric powered expansion valve based on the pressure value of the refrigerant detected by the pressure detecting means such that the pressure value of the refrigerant is adjusted to a prescribed pressure setting value.

This air conditioning system pressure adjusting device makes it possible to adjust the pressure of the refrigerant in the indoor heat exchanger to a prescribed pressure setting by adjusting the opening of the electric powered expansion valve. Consequently, the pressure of the refrigerant in the indoor heat exchanger can be adjusted to a higher pressure than the pressure of the refrigerant in the gaseous refrigerant pipe between the electric powered expansion valve and the compressor.

Thus, even when the outside air temperature is low, the pressure of the refrigerant downstream of the electric powered expansion valve in the gaseous refrigerant pipe can be lowered so as to prevent the gaseous refrigerant from liquefying. At the same time, the pressure of the refrigerant in the indoor heat exchanger can be adjusted such that the evaporation temperature of the refrigerant is a temperature at which the indoor heat exchanger will not freeze, thus preventing the indoor heat exchanger from freezing. As a result, the air conditioning system can be run continuously in cooling mode.

In the air conditioning system pressure adjusting device the opening adjusting means is capable of providing the electric powered expansion valve with an opening value that is appropriate for oil recovery mode when the system is run in oil recovery mode in order to return lubricating oil that has accumulated in the refrigerant circuit to the compressor.

With this pressure adjusting device, the opening adjusting means not only provides an opening for adjusting the pressure of the refrigerant in the indoor heat exchanger but also makes it possible to provide an opening that is appropriate for oil recovery mode when the system is run in oil recovery mode. Thus, the air conditioning system can be run in an oil recovery mode similar to the oil recovery mode of conventional air conditioning systems.

Also, an air conditioning system pressure adjusting device is described, wherein the electric powered expansion valve is installed in the indoor portion of the gaseous refrigerant pipe.

When the electric powered expansion valve is disposed in the outdoor portion of the gaseous refrigerant pipe, the refrigerant in the portion of the gaseous refrigerant pipe upstream of the electric powered expansion valve is cooled by the outside air and becomes partially liquefied. Then, the partially liquefied refrigerant is reduced in pressure by the electric powered expansion valve and the liquid portion is evaporated again before being drawn into the compressor. Consequently, if there is a portion where liquid accumulation occurs readily due to the shape and routing of the gaseous refrigerant pipe, there is the possibility that liquid refrigerant and oil will accumulate in the portion of the gaseous refrigerant pipe upstream of the electric powered expansion valve subjecting the compressor to conditions of insufficient oil and insufficient gaseous refrigerant intake.

Conversely, with the air conditioning system pressure adjusting device claimed here, temporary liquefaction of the refrigerant in the gaseous refrigerant pipe can be prevented because the electric powered expansion valve is disposed indoors instead of outdoors. Thus, conditions of insufficient oil and insufficient gaseous refrigerant intake do not occur at the compressor and the compressor can be protected more reliably.

Moreover, an air conditioning system pressure adjusting device, is described, wherein the electric powered expansion valve, the pressure detecting means, and the opening adjusting means are constructed as a single integral unit.

Since this air conditioning system pressure adjusting device is a single unit, it can be installed easily in, for example, the gaseous refrigerant pipe of an existing air conditioning system in order to prevent freezing of the indoor heat exchanger.

Also, an air conditioning system is provided with an outdoor unit, a plurality of indoor units, a gaseous refrigerant pipe, and a pressure adjusting device. The outdoor unit has a compressor and an outdoor heat exchanger. The indoor unit has a compressor and an indoor heat exchanger. The gaseous refrigerant pipe has a plurality of gaseous refrigerant branch pipes connected to the indoor heat exchangers of the respective indoor units and a gaseous refrigerant convergence pipe into which the gaseous refrigerant branch pipes converge and which is connected to the compressor. The pressure adjusting device is connected to some of the gaseous refrigerant branch pipes.

In this air conditioning system, the pressure adjusting device is provided with respect to some of the indoor units, i.e., more than one indoor unit but less than all of the indoor units. Thus, the indoor units that are provided with a pressure adjusting device can be run in cooling mode continuously even when the outside air temperature is low. For example, when a server room or other room having a large thermal load is provided in an office or the like by partitioning, the indoor unit installed in the room having the large thermal load can be run in cooling mode continuously even when the outside temperature is low by providing a pressure adjusting device for that indoor unit only, thereby preventing the gaseous refrigerant in the portion of the gaseous refrigerant branch pipe downstream of the electric powered expansion valve and in the gaseous refrigerant convergence pipe from liquefying and preventing the indoor unit from freezing.

Moreover, an air conditioning system is described, wherein the indoor units corresponding to the gaseous refrigerant branch pipes that do not have a pressure adjusting device connected thereto are connected to the outdoor unit in such a manner that they can switch between a cooling mode and a heating mode. The operating capacity of the outdoor unit can be adjusted in accordance with the total operating load resulting from the cooling operation and heating operation of the plurality of indoor units.

This air conditioning system has indoor units connected to the outdoor unit in such a manner that they can switch between cooling mode and heating mode and the operating capacity of its outdoor unit can be adjusted in accordance with the total operating load resulting from the cooling operation and heating operation of the plurality of indoor units. In short, it is the type of air conditioning system that is capable of so-called simultaneous heating and cooling. In the winter when the outside temperature is low, this kind of air conditioning system (i.e., one capable of simultaneous heating and cooling) generally performs heating in all rooms except those having large thermal loads, such as server rooms. In short, only the indoor units installed in rooms having large thermal loads, e.g., server rooms, are run in cooling mode. Since the refrigerant leaving the indoor units that are running in cooling mode returns to the outdoor unit through the gaseous refrigerant pipe, there is the possibility that the indoor heat exchangers of the indoor units running in cooling mode will freeze.

However, since the indoor units installed in rooms having large thermal loads and used exclusively for cooling are provided with pressure adjusting devices, those indoor units can be run in cooling mode continuously even when the outside temperature is low because the pressure adjusting devices prevent the gaseous refrigerant in the portions of the gaseous refrigerant branch pipes downstream of the electric powered expansion valves and in the gaseous refrigerant convergence pipe from liquefying and also prevent the indoor unit from freezing.

BRIEF DESCRIPTIONS OF THE DRAWINGS

PREFERRED EMBODIMENTS OF THE INVENTION

Embodiments of the present invention will now be described with reference to the drawings.

[First Embodiment]

(1) Constituent Features of the Air Conditioning System

Figure 1:
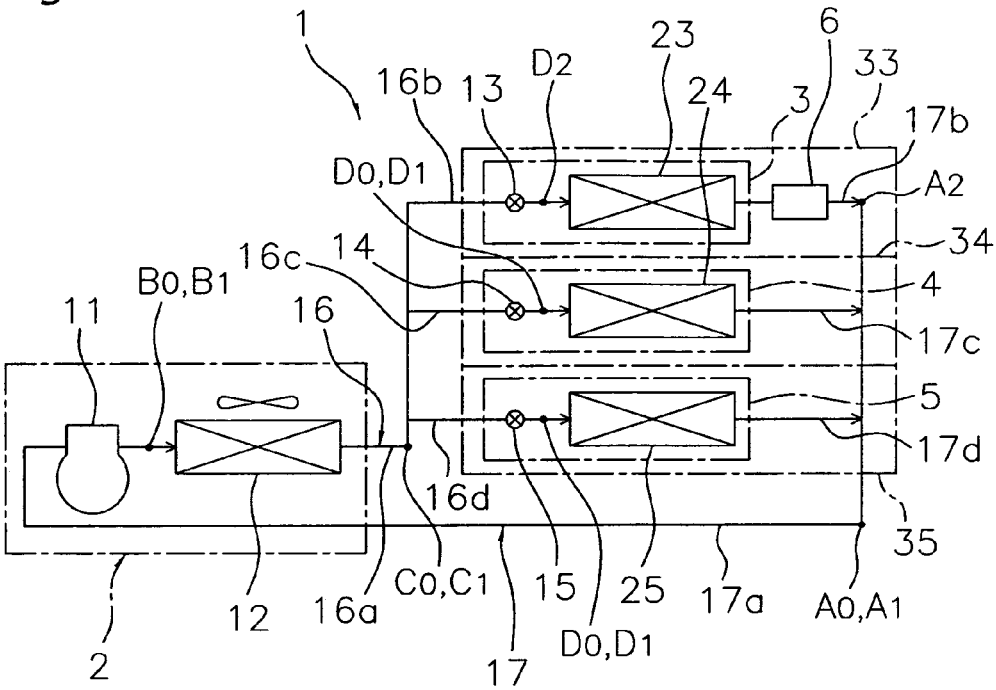
FIG. 1 is a schematic view of the refrigerant circuit of an air conditioning system in accordance with a first embodiment of the present invention.

FIG. 1 is a schematic view of the refrigerant circuit of an air conditioning system 1 in accordance with a first embodiment of the present invention. The air conditioning system 1 is equipped chiefly with one air-cooled outdoor unit 2 and a plurality of (three in this embodiment) indoor units 3, 4, 5 connected to the outdoor unit 2 in parallel. It is used, for example, to air-condition an office or the like. Among the indoor units 3, 4, 5, the indoor unit 3 is installed in a room 33 that is a server room fitted with server equipment. Consequently, the room 33 has a larger amount of discharged heat than the rooms 34, 35 in which the other indoor units 4, 5 are installed.

The outdoor unit 2 is equipped chiefly with a compressor 11 and an outdoor heat exchanger 12 and is installed outdoors. The compressor 11 is a device for compressing gaseous refrigerant to a prescribed pressure. The outdoor heat exchanger 12 is a device that exchanges heat between the refrigerant and the outside air and is a so-called air-cooled heat exchanger.

The indoor units 3, 4, 5 are equipped chiefly with an expansion valve 13, 14, 15 and an indoor heat exchanger 23, 24, 25. The expansion valves 13, 14, 15 serve to reduce the pressure of the liquid refrigerant that is condensed by the exchange of heat taking place in the outdoor heat exchanger 12. The indoor heat exchangers 23, 24, 25 are devices for exchanging heat between the refrigerant that has been pressure-reduced by the expansion valves 13, 14, 15 and the air inside each room.

The outdoor heat exchanger 12 and the expansion valves 13, 14, 15 are connected together by a liquid refrigerant pipe 16. The indoor heat exchangers 23, 24, 25 and the compressor 11 are connected together by a gaseous refrigerant pipe 17. The liquid refrigerant pipe 16 has a liquid refrigerant convergence pipe 16*a* that is connected to the outlet of the outdoor heat exchanger 12 and liquid refrigerant branch pipes 16*b*, 16*c*, 16*d* that are connected between the liquid refrigerant convergence pipe 16*a* and each of the expansion valves 13, 14, 15, respectively. The gaseous refrigerant pipe 17 has a gaseous refrigerant convergence pipe 17*a* that is connected to the inlet of the compressor 11 and gaseous refrigerant branch pipes 17*b*, 17*c*, 17*d* that are connected between the gaseous refrigerant convergence pipe 17*a* and each of the indoor heat exchangers 23, 24, 25, respectively. A pressure adjusting device 6 is installed in the gaseous refrigerant branch pipe 17*b*. Thus, the pressure adjusting device 6 is provided with respect to the indoor unit 3 installed in the room 33. The pressure adjusting device 6 functions to adjust the pressure of the refrigerant in the indoor heat exchanger 23 which refrigerant has been pressure-reduced by the expansion valve 13 to a higher pressure than the refrigerant in the indoor heat exchangers 24, 25 of the other indoor units 4, 5.

Figure 2:
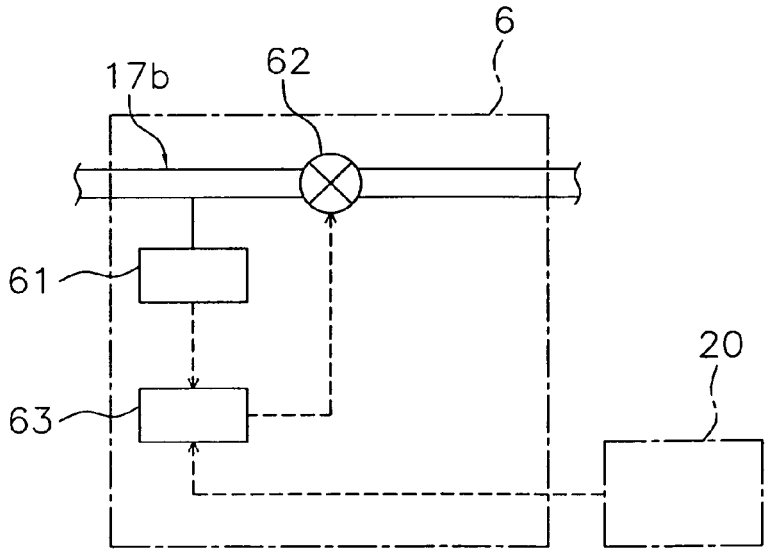
FIG. 2 is a schematic view of the pressure adjusting device of an air conditioning system in accordance with the first embodiment of the present invention.

(2) Constituent Features of the Pressure Adjusting Device of the Air Conditioning System FIG. 2 is a schematic view of the pressure adjusting device 6 of the air conditioning system 1. The pressure adjusting device 6 is a single unit equipped with a pressure detecting means 61, an electric powered expansion valve 62, and an opening adjusting means 63 and is arranged externally to the indoor unit 3.

The pressure detecting means 61 is a pressure gauge for detecting the pressure value of the refrigerant the indoor heat exchanger 23 of the indoor unit 3 and transmits the detected refrigerant pressure value to the opening adjusting means 63.

The opening adjusting means 63 is a control device that executes feedback control to adjust the opening of the electric powered expansion valve 62 based on the pressure value of the refrigerant detected by the pressure detecting means 61 such that the pressure value of the refrigerant is adjusted to a prescribed pressure setting value. The pressure setting value of the opening adjusting means 63 can be changed. The opening adjusting means 63 is capable of forcefully providing the electric powered expansion valve 62 with an opening value that is appropriate for oil recovery mode when the system runs in oil recovery mode in order to return lubricating oil that has accumulated in the gaseous refrigerant pipe 17 to the compressor 11; it provides this opening value in response to an oil recovery mode signal issued from the main control unit 20 of the air conditioning system 1.

The electric powered expansion valve 62 is disposed downstream of the pressure detecting means 61 and is an adjustable valve that can open an close automatically in response to a signal from the opening adjusting means 63.

Due to the constituent features described heretofore, the pressure adjusting device 6 can adjust the pressure of the refrigerant in the indoor heat exchanger 23 of the indoor unit 3 to a higher pressure than the refrigerant in the indoor heat exchangers 24, 25 of the other indoor units 4, 5.

(3) Operation of the Air Conditioning System and the Pressure Adjusting Device

The operation of the air conditioning system 1 and the pressure adjusting device 6 will now be described using FIGS. 1 to 3.

[1] Operation When Outside Air Temperature is High (Non-Winter Season)

Figure 3:
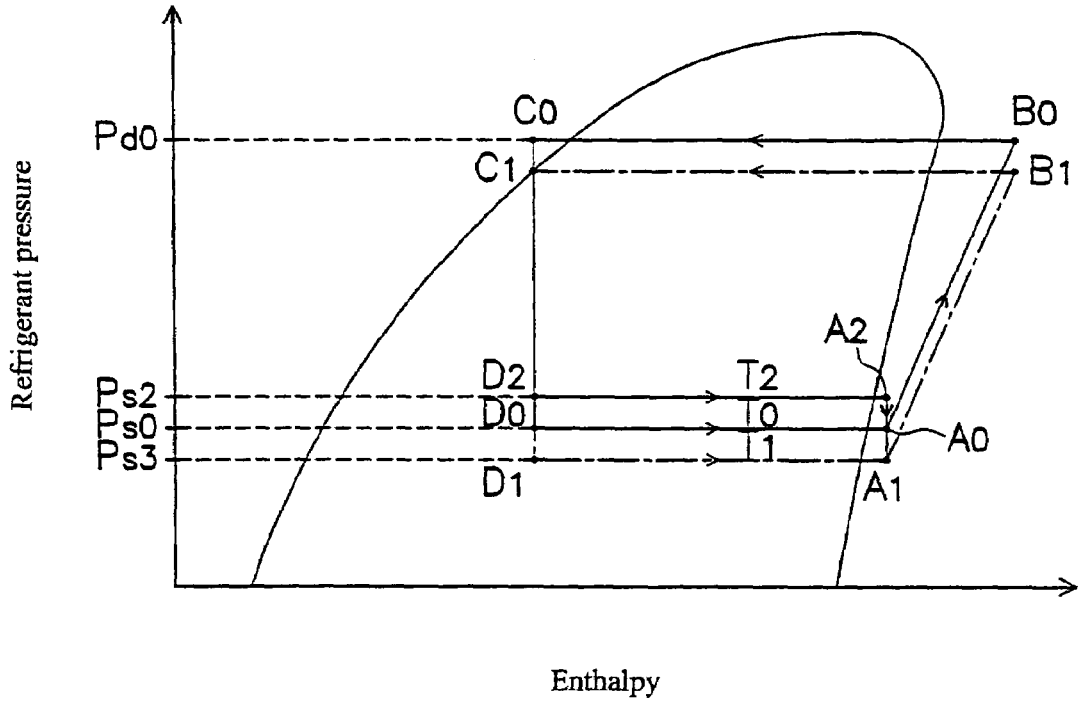
FIG. 3 is a Mollier diagram showing the refrigeration cycle of an air conditioning system in accordance with the first embodiment of the present invention.
Figure 4:
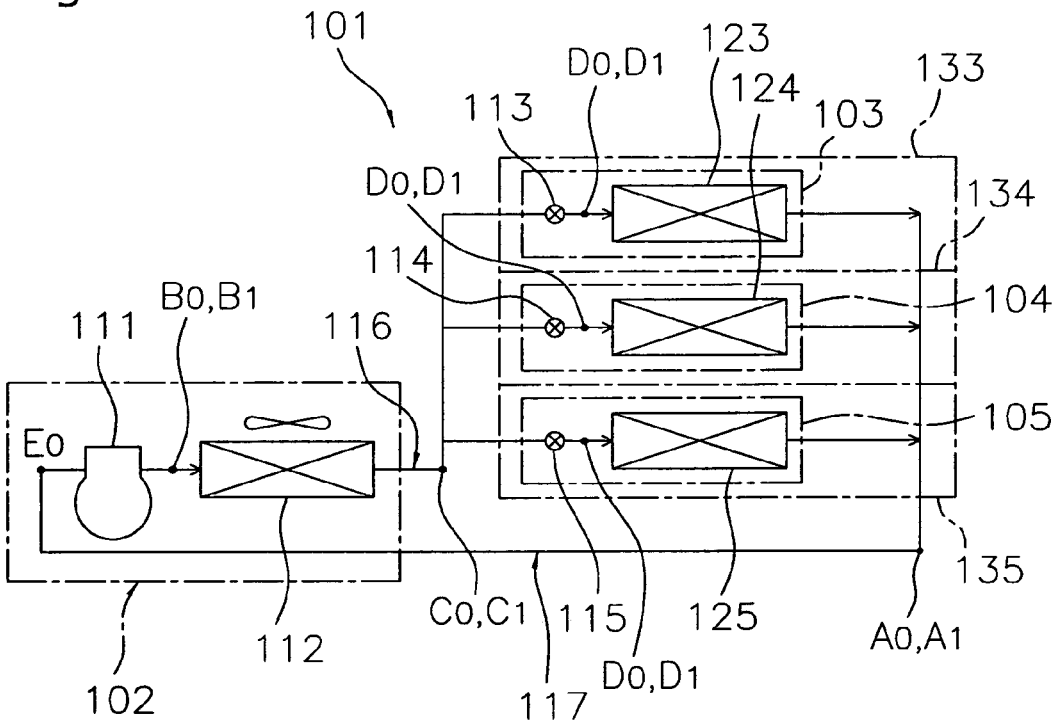
FIG. 4 is a schematic view of the refrigerant circuit of a conventional air conditioning system.
Figure 5:
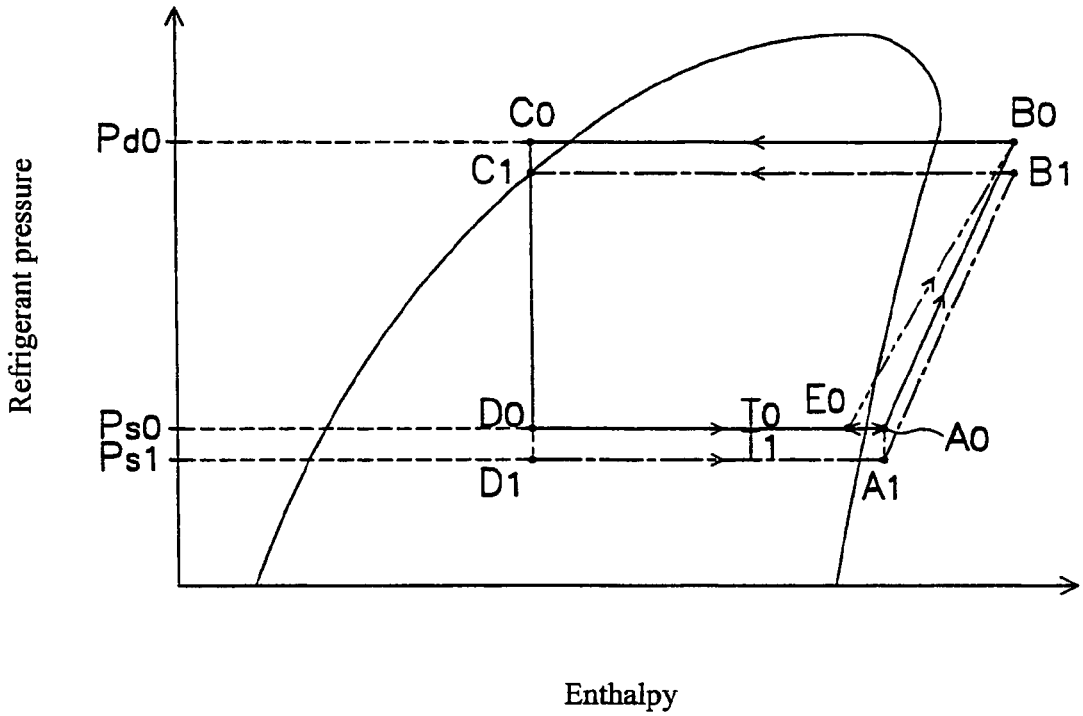
FIG. 5 is a Mollier diagram showing the refrigeration cycle of a conventional air conditioning system.

As shown in FIGS. 1 and 3, when the compressor 11 is started and the air conditioning system 1 is run, the gaseous refrigerant is compressed by the compressor 11 from the state at point A0 in FIGS. 1 and 3 to a prescribed pressure Pd0 (see point B0 in FIGS. 1 and 3) before being delivered to the outdoor heat exchanger 12. In the outdoor heat exchanger 12, the gaseous refrigerant exchanges heat with the outside air and condenses to a liquid refrigerant state (see point C0 in FIGS. 1 and 3). The condensed refrigerant liquid is fed from the outdoor heat exchanger 12 to the expansion valves 13, 14, 15 of the indoor units 3, 4, 5 through the liquid refrigerant pipe 16.

Next, the cycle from the expansion valves 13, 14, 15 to the gaseous refrigerant convergence pipe 17*a* will be explained. Since the construction of this portion of the refrigerant circuit is different for the indoor unit 3 in which the pressure adjusting device 6 is installed than for the other indoor units 4, 5, the two different arrangements are described separately.

In the arrangement of the indoor units 4 and 5, the liquid refrigerant is delivered from the outdoor heat exchanger 12 to the expansion valves 14, 15 of the indoor units 4, 5 through the liquid refrigerant convergence pipe 16*a* and the liquid refrigerant branch pipes 16*c*, 16*d* and the pressure of the liquid refrigerant is reduced to Ps0 (see point D0 in FIGS. 1 and 3) by the expansion valves 14, 15. In the indoor heat exchangers 24, 25, the pressure-reduced refrigerant exchanges heat with the air inside each respective room 34, 35 and evaporates, changing to a gaseous refrigerant state (see point A0 in FIGS. 1 and 3). The evaporation temperature of the refrigerant in the indoor heat exchangers 24, 25 is the temperature T0 corresponding to the pressure Ps0. This gaseous refrigerant passes through the gaseous refrigerant branch pipes 17*c*, 17*d* and converges into the gaseous refrigerant convergence pipe 17*a*.

In the arrangement of the indoor unit 3, the liquid refrigerant is delivered from the outdoor heat exchanger 12 to the expansion valve 13 of the indoor unit 3 through the liquid refrigerant convergence pipe 16*a* and the liquid refrigerant branch pipe 16*b* and the pressure of the liquid refrigerant is reduced to Ps2 (see point D2 in FIGS. 1 and 3) by the expansion valve 13. In the indoor heat exchanger 23, the pressure-reduced refrigerant exchanges heat with the air inside the room 33 and evaporates, changing to a gaseous refrigerant state (see point A2 in FIGS. 1 and 3). The evaporation temperature of the refrigerant in the indoor heat exchanger 23 is the temperature T2 corresponding to the pressure Ps2. Also, since the pressure adjusting device 6 is installed in the gaseous refrigerant branch pipe 17*b*, the pressure of the refrigerant that evaporated in the indoor heat exchanger 23 is reduced by the electric powered expansion valve 62 of the pressure adjusting device 6 to the same pressure Ps0 as the refrigerant in the other indoor heat exchangers 24, 25 before the refrigerant flows into the gaseous refrigerant convergence pipe 17*a*. In short, the pressure adjusting device 6 detects the evaporation pressure of the indoor heat exchanger 23 of the indoor unit 3 with the pressure detecting means 61 and adjusts the opening of the electric powered expansion valve 62 using the opening adjusting means 63 such that prescribed pressure setting value Ps2 is obtained.

Then, the gaseous refrigerant is drawn into the compressor 11 through the gaseous refrigerant convergence pipe 17*a*. In this way, the air inside the rooms 33, 34, 35 is cooled.

[2] Operation When Outside Air Temperature is Low (Winter Season)

The operation when the outside air temperature is low is basically the same as when the outside air temperature is high. The differences between the operation when the outside air temperature is low and the operation when the outside air temperature is high will now be described.

When the outside air temperature is low, i.e., lower than the temperature of the gaseous refrigerant, it becomes easy for the gaseous refrigerant to be cooled and liquefied within the gaseous refrigerant pipe 17 as it travels from the outlets of the indoor heat exchangers 23, 24, 25 to the compressor 11 through the gaseous refrigerant pipe 17. In order to prevent this from occurring, the intake pressure of the compressor 11 is set to a pressure Ps3 that is lower than the pressure used when the outside temperature is high (pressure Ps0).

Thus, the entire air conditioning system 1 operates at a lower refrigerant temperature. The indoor units 4 and 5 of the air conditioning unit 1 operate according to the refrigerant cycle indicated by the single-dot chain lines joining points A1, B1, C1, and D1 in FIG. 3 and the indoor unit 3 operates according to the refrigerant cycle indicated by the lines joining points A1, B1, C1, D2, A2, and A1 in FIG. 3.

Since the intake pressure of the compressor 11 falls from Ps0 to Ps3, the evaporation temperature of the refrigerant in the indoor heat exchangers 24, 25 of the indoor units 4, 5 falls to a temperature T1 at which there is the possibility that the indoor heat exchangers 24, 25 will freeze. If the indoor heat exchangers 24, 25 for the rooms 34, 35 freeze, the expansion valves 14, 15 are closed and the indoor units 4, 5 are operated in fan-only mode so that the indoor heat exchangers 24, 25 can be returned from their frozen state to a normal state. Consequently, such temporary inconveniences as a rise in the temperature inside the rooms 34, 35 occur. However, this is not a serious problem because the thermal loads of the rooms 34 and 35 are smaller than the thermal load of the room 33.

Meanwhile, the thermal load of the room 33 is large and the indoor heat exchanger 23 of the indoor unit 3 cannot be allowed to freeze if the server equipment is to be maintained at a normal operating state. Therefore, the pressure adjusting device 6 installed downstream of the indoor heat exchanger 23 adjusts the refrigerant pressure Ps2 of the indoor heat exchanger 23 such that the evaporation temperature becomes a temperature T2 (e.g., a temperature approximately equal to the evaporation temperature when the outside air temperature is high) at which freezing of the indoor heat exchanger 23 does not occur.

[3] Operation in Oil Recovery Mode

During partial load operation of the air conditioning system 1, lubricating oil from the compressor 11 accumulates chiefly in the gaseous refrigerant pipe 17. When this occurs, the system is operated in oil recovery mode, i.e., the expansion valves 13, 14, 15 disposed upstream of the indoor heat exchangers 23, 24, 25 are opened fully while running the compressor 11 in order to push the lubrication oil accumulated in the refrigerant circuit toward the inlet of the compressor 11. Since the electric powered expansion valve 62 of the pressure adjusting device 6 can also be opened fully in response to the fuel recovery mode start command from the main control unit 20 of the air conditioning system 1, the lubricating oil accumulated in the refrigerant piping of the indoor unit 3 is recovered in the same manner as the lubricating oil accumulated in the refrigerant piping of the indoor units 4 and 5.

(4) Characteristic Features of the Air Conditioning System Pressure Adjusting Device and Characteristic Features of an Air Conditioning System Equipped with the Same An air conditioning system pressure adjusting device and air conditioning system equipped with the same in accordance with this embodiment have the following characteristic features.

[1] Prevents Freezing of the Indoor Heat Exchanger

A pressure adjusting device 6 in accordance with this embodiment makes it possible to adjust the pressure of the refrigerant in the indoor heat exchanger 23 to a prescribed pressure setting by adjusting the opening of the electric powered expansion valve 62. As a result, the pressure of the refrigerant in the indoor heat exchanger 23 can be adjusted to a higher pressure than the pressure of the refrigerant in the gaseous refrigerant pipe 17 between the electric powered expansion valve 62 and the compressor 11. Thus, as shown in FIG. 3, even when the outside air temperature is low, the pressure of the refrigerant in the indoor heat exchanger 23 can be adjusted to a pressure Ps2 that is higher than the pressure Ps3 such that the gaseous refrigerant in the gaseous refrigerant pipe 17 downstream of the electric powered expansion valve 62 is prevented from liquefying and the evaporation temperature of the refrigerant becomes a temperature T2 at which the indoor heat exchanger 23 will not freeze. As a result, freezing of the indoor heat exchanger 23 is prevented and the indoor unit 3 can be run in cooling mode continuously.

The refrigerant pressure Ps2 of the indoor heat exchanger 23 can be adjusted easily by simply changing the pressure setting value of the opening adjusting means 63 of the pressure adjusting device.

Furthermore, in an air conditioning system 1 equipped with a plurality of indoor units 3, 4, 5, the indoor unit 3 installed in the room 33 where the thermal load is high can be run in cooling mode continuously even when the outside temperature is low by installing this kind of pressure adjusting device 6 for that indoor unit 3 only.

[2] Oil Recovery Mode

A pressure adjusting device 6 in accordance with this embodiment is easy to interlock with a command from the main control unit 20 of the air conditioning system 1 because the electric powered expansion valve 62 is electrically driven. The opening adjusting means 63 not only provides the electric powered expansion valve 62 with an opening for adjusting the pressure of the refrigerant in the indoor heat exchanger 23 but can also provide an opening that is appropriate for oil recovery mode when the system is run in oil recovery mode. Thus, the air conditioning system can be run in an oil recovery mode similar to the oil recovery mode of conventional air conditioning systems.

[3] Improves Reliability of Compressor Protection

When, for example, the electric powered expansion valve 62 is arranged in the outdoor portion of the gaseous refrigerant pipe 17, the refrigerant in the portion of the gaseous refrigerant pipe 17 upstream of the electric powered expansion valve 62 will be cooled by the outside air and partially liquefy. Then, the partially liquefied refrigerant is reduced in pressure by the electric powered expansion valve 62 and the liquid portion is evaporated again before being drawn into the compressor 11. Consequently, if there is a portion where liquid accumulation occurs readily due to the shape and routing of the gaseous refrigerant pipe 17, there is the possibility that liquid refrigerant and oil will accumulate in the portion of the gaseous refrigerant pipe 17 upstream of the electric powered expansion valve 62, thus subjecting the compressor 11 to conditions of insufficient oil and insufficient gaseous refrigerant intake.

Conversely, with a pressure adjusting device 6 in accordance with this embodiment, temporary liquefaction of the refrigerant in the gaseous refrigerant pipe 17 can be prevented because the electric powered expansion valve 62 is disposed indoors instead of outdoors. Thus, conditions of insufficient oil and insufficient gaseous refrigerant intake do not occur at the compressor 11 and the reliability of the compressor protection can be improved.

[3] Integration

Since a pressure adjusting device 6 in accordance with this embodiment is a single unit integrating the electric powered expansion valve 62, the pressure detecting means 61, and the opening adjusting means 63, it can be installed easily in, for example, the gaseous refrigerant pipe of an existing air conditioning system in order to prevent freezing of the indoor heat exchanger.

[Second Embodiment]

While the previous embodiment is an example of applying the present invention to an air conditioning system that is used exclusively for cooling, it is also acceptable to apply the invention to an air conditioning system designed for simultaneous heating and cooling. An air conditioning system 201 for simultaneous heating and cooling to which the present invention has been applied will now be described with reference to the drawings.

(1) Constituent Features of the Air Conditioning System

Figure 6:
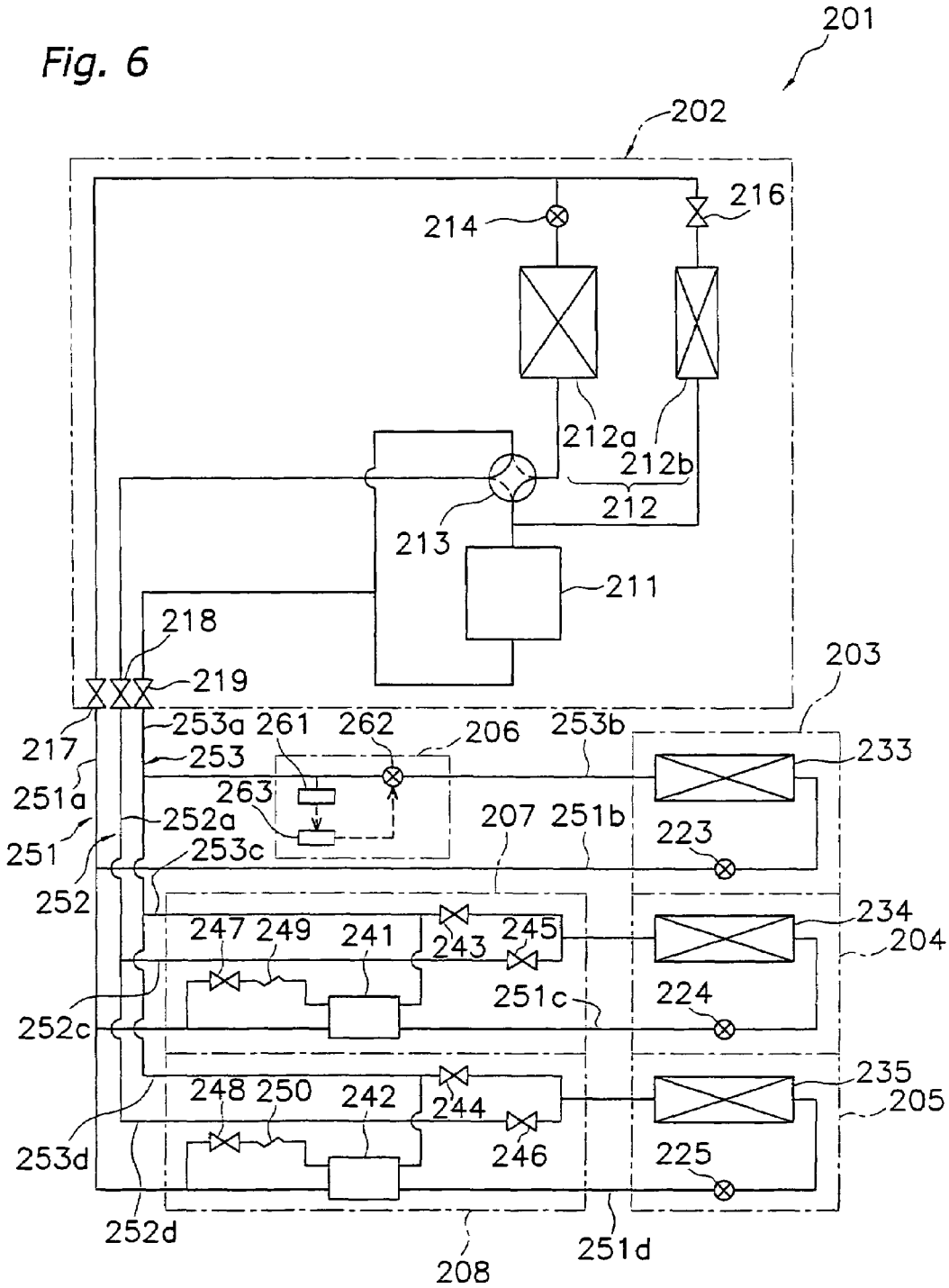
FIG. 6 is a schematic view of the refrigerant circuit of an air conditioning system in accordance with a second embodiment of the present invention.

FIG. 6 is a schematic view of the refrigerant circuit of an air conditioning system 201 in accordance with a second embodiment of the present invention. The air conditioning system 201 is provided chiefly with one air-cooled outdoor unit 202 and a plurality of (three in this embodiment) indoor units 203, 204, 205 connected in parallel to the outdoor unit 202. It is used, for example, to air-condition an office or the like. Among the indoor units 203, 204, 205, the indoor unit 203 is installed in a room that is a server room fitted with server equipment, similarly to the first embodiment. The server room has a larger amount of discharged heat than the rooms in which the other indoor units 204, 205 are installed. The indoor units 204 and 205 are connected to the outdoor unit 202 in such a manner that they can be switched between cooling mode and heating mode while the indoor unit 203 runs in cooling mode. The outdoor unit 202 is constituted such that its operating capacity can be adjusted in accordance with the total operating load resulting from the cooling operation and heating operation of the indoor units 203, 204, 205.

[1] Outdoor Unit

The outdoor unit 202 is installed outdoors and includes chiefly the following devices and valves, which are connected with refrigerant piping: a compressor 211, an outdoor main heat exchanger 212*a*, a four-way selector valve 213, an outdoor expansion valve 214, an outdoor auxiliary heat exchanger 212*b*, an outdoor solenoid valve 216, a liquid refrigerant shut-off valve 217, a first gaseous refrigerant shut-off valve 218, and a second gaseous refrigerant shut-off valve 219.

The compressor 211 is a device for compressing gaseous refrigerant. The intake side of the compressor 211 is connected to the four-way selector valve 213 and the second gaseous refrigerant shut-off valve 219. The discharge side of the compressor 211 is connected to the four-way selector valve 213 and the outdoor auxiliary heat exchanger 212*b*.

The outdoor main heat exchanger 212*a* is a heat exchanger for evaporating and condensing the refrigerant using the outside air as a heat source and forms the outdoor heat exchanger 212 together with the outside auxiliary heat exchanger 212*b*. The gas side of the outdoor main heat exchanger 212*a* is connected to the four-way selector valve 213. The liquid side of the outdoor main heat exchanger 212*a* is connected to the liquid refrigerant shut-off valve 217. The outdoor expansion valve 214 is provided between the liquid side of the outdoor main heat exchanger 212*a* and the liquid refrigerant shut-off valve 217. The outdoor expansion valve 214 is an electric powered expansion valve configured such that it can adjust the amount of refrigerant flowing through the outdoor main heat exchanger 212*a*.

The four-way selector valve 213 is a selector valve configured to make the outdoor main heat exchanger 212*a* function as either an evaporator or a condenser. The four-way selector valve 213 is connected to the gas side of the outdoor main heat exchanger 212*a*, the intake side of the compressor 211, the discharge side of the compressor 211, and the first gaseous refrigerant shut-off valve 218. When it makes the outdoor main heat exchanger 212*a* function as a condenser, the four-way selector valve 213 can connect the discharge side of the compressor 211 to the gas side of the outdoor main heat exchanger 212*a* and connect the intake side of the compressor 211 to the first gaseous refrigerant shut-off valve 218. Conversely, when it makes the outdoor main heat exchanger 212*a* function as an evaporator, the four-way selector valve 213 can connect the gas side of the outdoor main heat exchanger 212*a* to the intake side of the compressor 211 and connect the discharge side of the compressor 211 to the first gaseous refrigerant shut-off valve 218.

The outdoor auxiliary heat exchanger 212*b* is connected in parallel with the outdoor main heat exchanger 212*a* and serves to condense the refrigerant using the outside air as a heat source. The outdoor solenoid valve 216 that can be opened and closed when necessary is provided on the liquid side of the outdoor auxiliary heat exchanger 212*b*. As a result, the overall refrigerant evaporation amount of the outdoor heat exchanger 212 can be adjusted.

[2] Indoor Units

The indoor units 203, 204, 205 are each equipped chiefly with an expansion valve 223, 224, 225 and an indoor heat exchanger 233, 234, 235 and these devices and valves are connected together with refrigerant piping. The indoor expansion valves 223, 224, 225 are electric powered expansion valves for reducing the pressure of the liquid refrigerant during operation in cooling mode. The indoor heat exchangers 233, 234, 235 function as refrigerant condensers during heating mode and as refrigerant evaporators during cooling mode.

[3] Refrigerant Piping

In this embodiment, the liquid refrigerant pipe 251, the first gaseous refrigerant pipe 252, and the second gaseous refrigerant pipe 253 are connected to the outdoor unit 202.

The liquid refrigerant pipe 251 serves to connect the liquid refrigerant shut-off valve 217 of the outdoor unit 202 to the indoor units 203, 204, 205 and includes the following: liquid refrigerant branch pipes 251*b*, 251*c*, 251*d* corresponding to the respective indoor units 203, 204, 205; and a liquid refrigerant convergence pipe 251*a* into which the liquid refrigerant branch pipes 251*b*, 251*c*, 251*d* converge and which is connected to the liquid refrigerant shut-off valve 217. The liquid refrigerant branch pipe 251*b* is connected to the indoor expansion valve 223 of the indoor unit 203. The liquid refrigerant branch pipe 251*c* runs from its junction with the liquid refrigerant convergence pipe 251*a* and connects to the indoor expansion valve 224 of the indoor unit 204, passing through the heating/cooling changeover device 207 (discussed later) in-between. The liquid refrigerant branch pipe 251*d* runs from its junction with the liquid refrigerant convergence pipe 251*a* and connects to the indoor expansion valve 225 of the indoor unit 205, passing through the heating/cooling changeover device 208 (discussed later) in-between.

The first gaseous refrigerant pipe 252 serves to connect the first gaseous refrigerant shut-off valve 218 of the outdoor unit 202 to the indoor units 204, 205 (i.e., the indoor units other than the indoor unit 203) and includes the following: first gaseous refrigerant branch pipes 252*c*, 252*d* corresponding to the respective indoor units 204, 205; and a first gaseous refrigerant convergence pipe 252*a* into which the first gaseous refrigerant branch pipes 252*c*, 252*d* converge and which is connected to the first gaseous refrigerant shut-off valve 218. The first gaseous refrigerant branch pipe 252*c* runs from its junction with the first gaseous refrigerant convergence pipe 252*a* and connects to the indoor heat exchanger 234 of the indoor unit 204, passing through the heating/cooling changeover device 207 in-between. The first gaseous refrigerant branch pipe 252*d* runs from its junction with the first gaseous refrigerant convergence pipe 252*a* and connects to the indoor heat exchanger 235 of the indoor unit 205, passing through the heating/cooling changeover device 208 in-between.

The second gaseous refrigerant pipe 253 serves to connect the second gaseous refrigerant shut-off valve 219 of the outdoor unit 202 to the indoor units 203, 204, 205 and includes the following: second gaseous refrigerant branch pipes 253*b*, 253*c*, 253*d* corresponding to the respective indoor units 203, 204, 205; and a second gaseous refrigerant convergence pipe 253*a* into which the second gaseous refrigerant branch pipes 253*b*, 253*c*, 253*d* converge and which is connected to the second gaseous refrigerant shut-off valve 219. The second gaseous refrigerant branch pipe 253*b* runs from its junction with the second gaseous refrigerant convergence pipe 253*a* and connects to the indoor heat exchanger 233 of the indoor unit 203, passing through the pressure adjusting device 206 (discussed later) in-between. The second gaseous refrigerant branch pipe 253*c* runs from its junction with the second gaseous refrigerant convergence pipe 253*a* and connects to the indoor heat exchanger 234 of the indoor unit 204, passing through the heating/cooling changeover device 207 in-between. The second gaseous refrigerant branch pipe 253*d* runs from its junction with the second gaseous refrigerant convergence pipe 253*a* and connects to the indoor heat exchanger 235 of the indoor unit 205, passing through the heating/cooling changeover device 208 in-between.

[4] Pressure Adjusting Device

Similarly to the pressure adjusting device 6 of the first embodiment, the pressure adjusting device 206 is a single unit equipped with a pressure detecting means 261, an electric powered expansion valve 262, and an opening adjusting means 263. It is provided in the second gaseous refrigerant branch pipe 253*b*, which connects the outdoor unit 202 and the indoor unit 203 together. The pressure adjusting device 206 can adjust the pressure of the refrigerant in the indoor heat exchanger 233 of the indoor unit 203 to a higher pressure than the refrigerant in the indoor heat exchangers 234, 235 of the other indoor units 204, 205. Also, again similarly to the pressure adjusting device 6 of the first embodiment, the opening adjusting means 263 of the pressure adjusting device 206 is capable of forcefully providing the electric powered expansion valve 262 with an opening value that is appropriate for oil recovery mode in response to an oil recovery mode signal issued from the main control unit 20 of the air conditioning system 201 when oil recovery mode is executed.

[5] Heating/Cooling Changeover Device

The indoor units 207, 208 are each equipped chiefly with a subcooling heat exchanger 241, 242, a low-pressure gaseous refrigerant return valve 243, 244, and a high-pressure gaseous refrigerant supply valve 245, 246.

The heating/cooling changeover devices 207, 208 are configured such that, when the indoor units 204, 205 run in cooling mode, liquid refrigerant can be supplied from the outdoor unit 202 to the indoor units 204, 205 through the liquid refrigerant branch pipes 251*c*, 251*d* of the liquid refrigerant pipe 251 and the subcooling heat exchangers 241, 242. The heating/cooling changeover devices 207, 208 are further configured such that refrigerant evaporated in the indoor heat exchangers 234, 235 of the indoor units 204, 205 can be delivered to the second gaseous refrigerant branch pipes 253*c*, 253*d* of the second gaseous refrigerant pipe 253 through the low-pressure gaseous refrigerant return valves 243, 244.

The heating/cooling changeover devices 207, 208 are configured such that, when the indoor units 204, 205 run in heating mode, gaseous refrigerant can be supplied from the outdoor unit 202 to the indoor units 204, 205 through the first gaseous refrigerant branch pipes 252*c*, 252*d* of the first gaseous refrigerant pipe 252 and the high-pressure gaseous refrigerant supply valves 245, 246. The heating/cooling changeover devices 207, 208 are further configured such that refrigerant condensed in the indoor heat exchangers 234, 235 of the indoor units 204, 205 can be delivered to the liquid refrigerant branch pipes 251*c*, 251*d* of the liquid refrigerant pipe 251 through the subcooling heat exchangers 241, 242.

The subcooling heat exchangers 241, 242 serve to subcool the liquid refrigerant supplied to the indoor units 204, 205 from the outdoor unit 202. More specifically, the heating/cooling changeover devices 207, 208 each have a subcooling valve 247, 248 and a capillary 249, 250 for reducing the pressure of a portion of the liquid refrigerant that is supplied to the heating/cooling changeover devices 207, 208 from the liquid refrigerant branch pipes 251*c*, 251*d* during cooling mode. The subcooling heat exchangers 241, 242 cool the liquid refrigerant heading toward the indoor units 204, 205 to a subcooled state using this pressure-reduced refrigerant as a cooling source. Meanwhile, after the refrigerant used as a cooling source is evaporated in the subcooling heat exchangers 241, 242, it is returned downstream of the low-pressure gaseous refrigerant return valves 243, 244 and converges with the refrigerant evaporated in the indoor units 204, 205.

The indoor unit 203 differs from the indoor units 204, 205 in that it is a dedicated cooling unit connected to a pressure adjusting device 206 instead of a heating/cooling changeover device 207, 208. In short, the air conditioning system 201 is configured such that it can perform simultaneous heating and cooling. Thus, for example, the indoor unit 203 installed in a server room can be run in cooling mode while the indoor units 204, 205 are run in heating mode or the indoor unit 203 and the indoor unit 204 can be run in cooling mode while the indoor unit 205 is run in heating mode.

(2) Operation of the Air Conditioning System

The operation of the air conditioning system 201 of this embodiment will now be described for a case in which the outside air temperature is low (winter season) using FIG. 7. In this description, it will be assumed that, when the outside air temperature is low (winter season), the indoor unit 203 of the air conditioning system 201 operates in cooling mode in order to cool the air inside the server room and the indoor units 204, 205 operate in heating mode.

Figure 7:
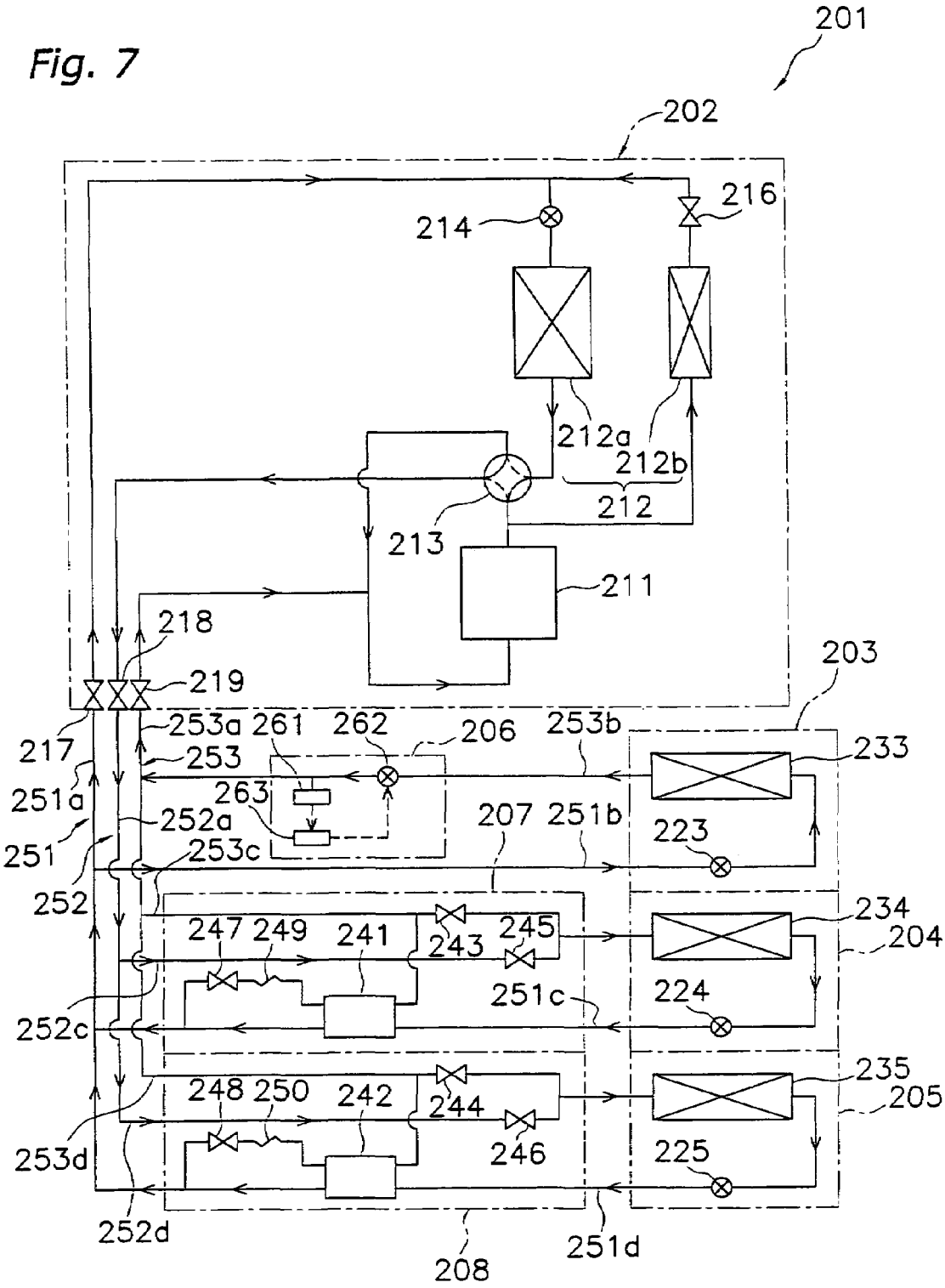
FIG. 7 is a diagram illustrating the flow of the refrigerant during simultaneous heating and cooling operation in an air conditioning system in accordance with the second embodiment of the present invention.

During an operating mode in which heating and cooling are mixed in this manner, the refrigerant circuit of the air conditioning system 201 is configured as shown in FIG. 7 (the flow of the refrigerant is indicated by arrows in the figure).

The outdoor unit 202 is configured such that, when the operating load for heating is larger than the operating load for cooling, the outdoor main heat exchanger 212*a* can be made to operate as an evaporator by switching the four-way selector valve 213 to the heating position (broken line in FIG. 7) and the outdoor auxiliary heat exchanger 212*b* can be made to operate as a condenser by opening the outdoor solenoid valve 216 in accordance with the heating operating load.

First, except for a portion that is directed to the outdoor auxiliary heat exchanger 212*b*, the gaseous refrigerant compressed by the compressor 211 is fed to the indoor units 204, 205 through the four-way selector valve 213, the first gaseous refrigerant shut-off valve 218 and the first gaseous refrigerant pipe 252.

The gaseous refrigerant fed to the indoor units 204, 205 is directed through the high-pressure gaseous refrigerant supply valves 245, 246 of the heating/cooling changeover devices 207, 208 and into the indoor heat exchangers 234, 235 of the indoor units 204, 205, where it condenses and heats the air in the respective rooms. Then, the condensed refrigerant passes through the indoor expansion valves 224, 225 and the subcooling heat exchangers 241, 242 of the heating/cooling changeover devices 207, 208 and into the liquid refrigerant pipe 251. Except for a portion of the refrigerant that is fed into the liquid refrigerant branch pipe 251*b* to facilitate the cooling mode operation of the indoor unit 203, the condensed refrigerant passes through the liquid refrigerant convergence pipe 251*a* and returns to the outdoor unit 202.

Meanwhile, the portion of the gaseous refrigerant compressed by the compressor 211 that is directed to the outdoor auxiliary heat exchanger 212*b* is condensed. This condensed refrigerant is mixed with the refrigerant returning from the indoor units 204, 205 through the liquid refrigerant pipe 251, reduced in pressure by the outdoor expansion valve 214, and directed into the outdoor main heat exchanger 212*a*, where it is evaporated. Then, the evaporated refrigerant is drawn into the compressor 211 again through the four-way selector valve 213. In short, the flow rate of the gaseous refrigerant supplied from the outdoor unit 202 to the indoor units 204, 205 through the first gaseous refrigerant pipe 252 is adjusted by the condensation of refrigerant performed by the outdoor auxiliary heat exchanger 212*b* and the flow rate adjustment executed by the outdoor expansion valve 214.

The portion of refrigerant condensed in the indoor units 204, 205 is directed to the indoor unit 203 through the liquid refrigerant branch pipe 251*b*. Then, after the refrigerant is reduced in pressure by the indoor expansion valves 223, it is evaporated in the indoor heat exchanger 233 and cools the air inside the server room before being fed to the pressure adjusting device 206. Similarly to the first embodiment, the pressure adjusting device 206 adjusts the refrigerant pressure in the indoor heat exchanger 233 (corresponds to Ps2 in FIG. 3) so as to achieve an evaporation temperature (corresponds to T2 in FIG. 3) at which the indoor heat exchanger 233 does not freeze. After having its pressure reduced by the pressure adjusting device 206, the refrigerant is returned to the intake side of the compressor 211 of the outdoor 202 unit through the second gaseous refrigerant pipe 253.

There are times when the heating load of the indoor units 204, 205 is small. In particular, in recent office buildings the amount of heat emitted from computers and OA equipment in rooms other than the server room is large and, consequently, there are times when the heating load is small even in the winter when the outside air temperature is low. In such a situation, the flow rate of gaseous refrigerant returning to the outdoor unit 202 through the liquid refrigerant pipe 251 from the indoor units 204, 205 becomes small and the flow rate of gaseous refrigerant returning to the outdoor unit 202 through the second gaseous refrigerant pipe 253 from the indoor unit 203 becomes relatively large.

Under such conditions, without the pressure adjusting device 206, the refrigerant pressure inside the indoor heat exchanger 233 would become too low and the possibility of the indoor heat exchanger 233 freezing would be high. Furthermore, if the system were operated at a refrigerant pressure at which the indoor heat exchanger 233 does not freeze, the influence of the gaseous refrigerant returned to the outdoor unit 202 through the second gaseous refrigerant pipe 253 from the indoor unit 203 would become large and it would be possible for the gaseous refrigerant to liquefy on the intake side of the compressor 211. Conversely, since the system is provided with a pressure adjusting device 206, even when the outside air temperature is low, the indoor unit 203 can be run continuously in cooling mode because the gaseous refrigerant in the second the gaseous refrigerant pipe 253 is prevented from liquefying and the indoor heat exchanger 233 is prevented from freezing.

As described heretofore, when the present invention is applied to an air conditioning system 201 that is capable of simultaneous heating and cooling, the same effects as the first embodiment can be obtained. Even when the outside air temperature is low, the room (e.g., a server room) having a large thermal load can be cooled continuously while performing simultaneous heating and cooling.

[Other Embodiments]

Although embodiments of the present invention have been described herein with reference to the drawings, the specific constituent features are not limited to those of these embodiments and variations can be made within a scope that does not deviate from the gist of the invention.

(1) Although the previously described embodiments applied the invention to air conditioning systems used for cooling only or for simultaneous heating and cooling, the invention can also be applied to an air conditioning system that switches between cooling and heating modes.

(2) The numbers of rooms are not limited to the numbers mentioned in the embodiments.

(3) In the first embodiment, the pressure adjusting device is operated even during non-winter seasons such that the refrigerant pressure in the corresponding indoor heat exchanger is higher than the refrigerant pressure in the other indoor heat exchangers. However, it is also acceptable to open the electric powered expansion valve fully during non-winter seasons such that the corresponding indoor heat exchanger is used at the same refrigerant pressure as the other indoor heat exchangers and to operate the pressure adjusting device only during the winter season.

(4) In the second embodiment, one of the indoor units making up the simultaneous heating and cooling type air conditioning system is a dedicated cooling unit that is not connected to a heating/cooling changeover device, but the invention is not limited to such an arrangement. For example, the simultaneous heating and cooling type air conditioning system could be configured such that all of the indoor units are connected to a heating/cooling changeover device and the indoor unit used to cool the server room or other room with a high thermal load could have a pressure adjusting device connected in series with the heating/cooling changeover device.

APPLICABILITY TO INDUSTRY

By using the present invention, the refrigerant pressure in the indoor heat exchanger can be adjusted to a higher pressure than the refrigerant pressure in the gaseous refrigerant pipe between the electric powered expansion valve and the compressor. Therefore, even when the outside air temperature is low, the refrigerant pressure in the gaseous refrigerant pipe downstream of the electric powered expansion valve can be lowered so as to prevent the gaseous refrigerant from liquefying and the refrigerant pressure in the indoor heat exchanger can be adjusted such that the evaporation temperature of the refrigerant is a temperature at which the indoor heat exchanger will not freeze, thus preventing the indoor heat exchanger from freezing. As a result, continuous operation in cooling mode can be accomplished even when the outside air temperature is low.

What is claimed is:

1. A pressure adjusting device for adjusting pressure in an indoor heat exchanger of an air conditioning system, comprising:

pressure detecting means for detecting a pressure value of refrigerant in the indoor heat exchanger;

an electric powered expansion valve configured to be installed in a gaseous refrigerant pipe that connects the indoor heat exchanger to a compressor of an outdoor unit of the air conditioning system; and opening adjusting means that adjusts an opening of the electric powered expansion valve based on the pressure value of the refrigerant detected by the pressure detecting means such that the pressure value of the refrigerant is adjusted to a prescribed pressure setting value, the opening adjusting means being configured to provide the electric powered expansion valve with an opening value that is appropriate for an oil recovery mode when the air conditioning system runs in the oil recovery mode in order to return lubricating oil that has accumulated in a refrigerant circuit to the compressor.

2. The pressure adjusting device as recited in claim 1, wherein the electric powered expansion valve is configured to be installed in an indoor portion of the gaseous refrigerant pipe.

3. The pressure adjusting device as recited in claim 1, wherein the electric powered expansion valve, the pressure detecting means, and the opening adjusting means are constructed as a single integral unit.

4. The pressure adjusting device as recited in claim 1, wherein the electric powered expansion valve is configured to be installed in an indoor portion of the gaseous refrigerant pipe.

5. The pressure adjusting device as recited in claim 4, wherein the electric powered expansion valve, the pressure detecting means, and the opening adjusting means are constructed as a single integral unit.

6. An air conditioning system comprising:

an outdoor unit having a compressor and an outdoor heat exchanger;

first and second indoor units having first and second indoor heat exchangers, respectively;

a gaseous refrigerant pipe having gaseous refrigerant branch pipes connected to the first and second indoor heat exchangers of the first and second indoor units, and a gaseous refrigerant convergence pipe into which the gaseous refrigerant branch pipes converge and which is connected to the compressor; and a pressure adjusting device connected to the gaseous refrigerant branch pipe of the first indoor heat exchanger, the pressure adjusting device including pressure detecting means for detecting a pressure value of refrigerant in the first indoor heat exchanger;

an electric powered expansion valve installed in the gaseous refrigerant pipe; and opening adjusting means that adjusts an opening of the electric powered expansion valve based on the pressure value of the refrigerant detected by the pressure detecting means such that the pressure value of the refrigerant is adjusted to a prescribed pressure setting value, the opening adjusting means being configured to provide the electric powered expansion valve with an opening value that is appropriate for an oil recovery mode when the air conditioning system runs in the oil recovery mode in order to return lubricating oil that has accumulated in a refrigerant circuit to the compressor.

7. The air conditioning system as recited in claim 6, wherein the electric powered expansion valve is installed in an indoor portion of the gaseous refrigerant pipe.

8. The air conditioning system as recited in claim 6, wherein the electric powered expansion valve, the pressure detecting means, and the opening adjusting means are constructed as a single integral unit.

9. The air conditioning system as recited in claim 6, wherein the electric powered expansion valve is installed in an indoor portion of the gaseous refrigerant pipe.

10. The air conditioning system as recited in claim 9, wherein the electric powered expansion valve, the pressure detecting means, and the opening adjusting means are constructed as a single integral unit.

11. The air conditioning system as recited in claim 10, wherein the second indoor unit is connected to the outdoor unit in such a manner that it can switch between a cooling mode and a heating mode; and an operating capacity of the outdoor unit can be adjusted in accordance with a total operating load resulting from cooling operations and heating operations of the first and second indoor units.

12. An air conditioning system comprising:

an outdoor unit having a compressor and an outdoor heat exchanger;

first and second indoor units having first and second indoor heat exchangers, respectively;

a gaseous refrigerant pipe having gaseous refrigerant branch pipes connected to the first and second indoor heat exchangers of the first and second indoor units, and a gaseous refrigerant convergence pipe into which the gaseous refrigerant branch pipes converge and which is connected to the compressor; and a pressure adjusting device connected to the gaseous refrigerant branch pipe of the first indoor heat exchanger, the pressure adjusting device including pressure detecting means for detecting a pressure value of refrigerant in the first indoor heat exchanger;

an electric powered expansion valve installed in the gaseous refrigerant pipe; and opening adjusting means that adjusts an opening of the electric powered expansion valve based on the pressure value of the refrigerant detected by the pressure detecting means such that the pressure value of the refrigerant is adjusted to a prescribed pressure setting value, the second indoor unit being connected to the outdoor unit in such a manner that it can switch between a cooling mode and a heating mode, and an operating capacity of the outdoor unit being adjusted in accordance with a total operating load resulting from cooling operations and heating operations of the first and second indoor units.

13. A pressure adjusting device comprising:

a pressure detecting device configured and arranged to detect a pressure value of refrigerant in an indoor heat exchanger of an air conditioning system;

an electric powered expansion valve configured to be installed in a gaseous refrigerant pipe that connects the indoor heat exchanger to a compressor of an outdoor unit of the air conditioning system; and an opening adjusting device configured and arranged to adjust an opening of the electric powered expansion valve based on the pressure value of the refrigerant detected by the pressure detecting device such that the pressure value of the refrigerant is adjusted to a prescribed pressure setting value, the opening adjusting device being configured to provide the electric powered expansion valve with an opening value that is appropriate for an oil recovery mode when the air conditioning system runs in the oil recovery mode in order to return lubricating oil that has accumulated in a refrigerant circuit to the compressor.

14. The pressure adjusting device as recited in claim 13, wherein the electric powered expansion valve is configured to be installed in an indoor portion of the gaseous refrigerant pipe.

15. The pressure adjusting device as recited in claim 14, wherein the electric powered expansion valve, the pressure detecting device, and the opening adjusting device are constructed as a single integral unit.

16. An air conditioning system comprising:

an outdoor unit having a compressor and an outdoor heat exchanger;

first and second indoor units having first and second indoor heat exchangers, respectively;

a gaseous refrigerant pipe having gaseous refrigerant branch pipes connected to the first and second indoor heat exchangers of the first and second indoor units, and a gaseous refrigerant convergence pipe into which the gaseous refrigerant branch pipes converge and which is connected to the compressor; and a pressure adjusting device connected to the gaseous refrigerant branch pipe of the first indoor heat exchanger, the pressure adjusting device including a pressure detecting device configured and arranged to detect a pressure value of refrigerant in the first indoor heat exchanger;

an electric powered expansion valve installed in the gaseous refrigerant pipe; and an opening adjusting device configured and arranged to adjust an opening of the electric powered expansion valve based on the pressure value of the refrigerant detected by the pressure detecting device such that the pressure value of the refrigerant is adjusted to a prescribed pressure setting value, the opening adjusting device being configured to provide the electric powered expansion valve with an opening value that is appropriate for an oil recovery mode when the air conditioning system runs in the oil recovery mode in order to return lubricating oil that has accumulated in a refrigerant circuit to the compressor.

17. An air conditioning system comprising:

an outdoor unit having a compressor and an outdoor heat exchanger;

first and second indoor units having first and second indoor heat exchangers, respectively;

a gaseous refrigerant pipe having gaseous refrigerant branch pipes connected to the first and second indoor heat exchangers of the first and second indoor units, and a gaseous refrigerant convergence pipe into which the gaseous refrigerant branch pipes converge and which is connected to the compressor; and a pressure adjusting device connected to the gaseous refrigerant branch pipe of the first indoor heat exchanger, the pressure adjusting device including a pressure detecting device configured and arranged to detect a pressure value of refrigerant in the first indoor heat exchanger;

an electric powered expansion valve installed in the gaseous refrigerant pipe; and an opening adjusting device configured and arranged to adjust an opening of the electric powered expansion valve based on the pressure value of the refrigerant detected by the pressure detecting device such that the pressure value of the refrigerant is adjusted to a prescribed pressure setting value, the second indoor unit being connected to the outdoor unit in such a manner that it can switch between a cooling mode and a heating mode, and an operating capacity of the outdoor unit being adjusted in accordance with a total operating load resulting from cooling operations and heating operations of the first and second indoor units.

* * * * *